United States Patent [19]

Smith

[11] 4,003,275

[45] Jan. 18, 1977

[54] WRENCH

[76] Inventor: Rodney W. Smith, 83353 Spruce Lane, Florence, Oreg. 97439

[22] Filed: Feb. 25, 1976

[21] Appl. No.: 661,034

[52] U.S. Cl. ..... 81/57.29

[51] Int. Cl.[2] ..... B25B 17/00

[58] Field of Search ..... 81/57.29, 121 B, 60–63.2

[56] References Cited

UNITED STATES PATENTS

| | | | |
|---|---|---|---|
| 858,892 | 7/1907 | Moss | 81/57.29 |
| 3,732,756 | 5/1973 | Thomasian | 81/62 |

FOREIGN PATENTS OR APPLICATIONS

| | | | |
|---|---|---|---|
| 1,295,729 | 5/1962 | France | 81/57.29 |

*Primary Examiner*—James L. Jones, Jr.
*Attorney, Agent, or Firm*—Blair & Brown

[57] ABSTRACT

A wrench having an elongated handle and a socket drive member rotatably mounted in one end of the handle. A shaft extends through the handle to a knob at the end thereof opposite the drive and is connected to the drive member by a gear connection between the shaft and the drive member. The gearing includes a worm so as to prevent the rotation of the drive member with respect to the wrench except when the shaft is turned. The wrench is useful in positions wherein it is difficult to start a bolt with the fingers.

1 Claim, 6 Drawing Figures

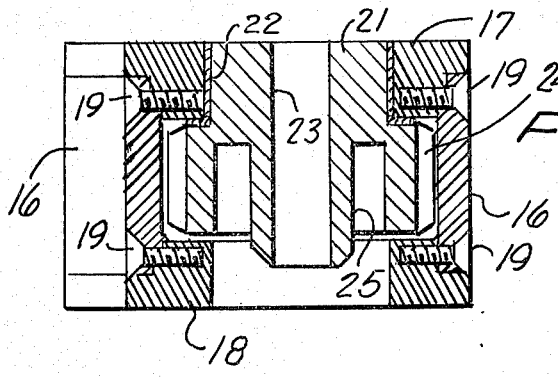
FIG. 5.
FIG. 6.
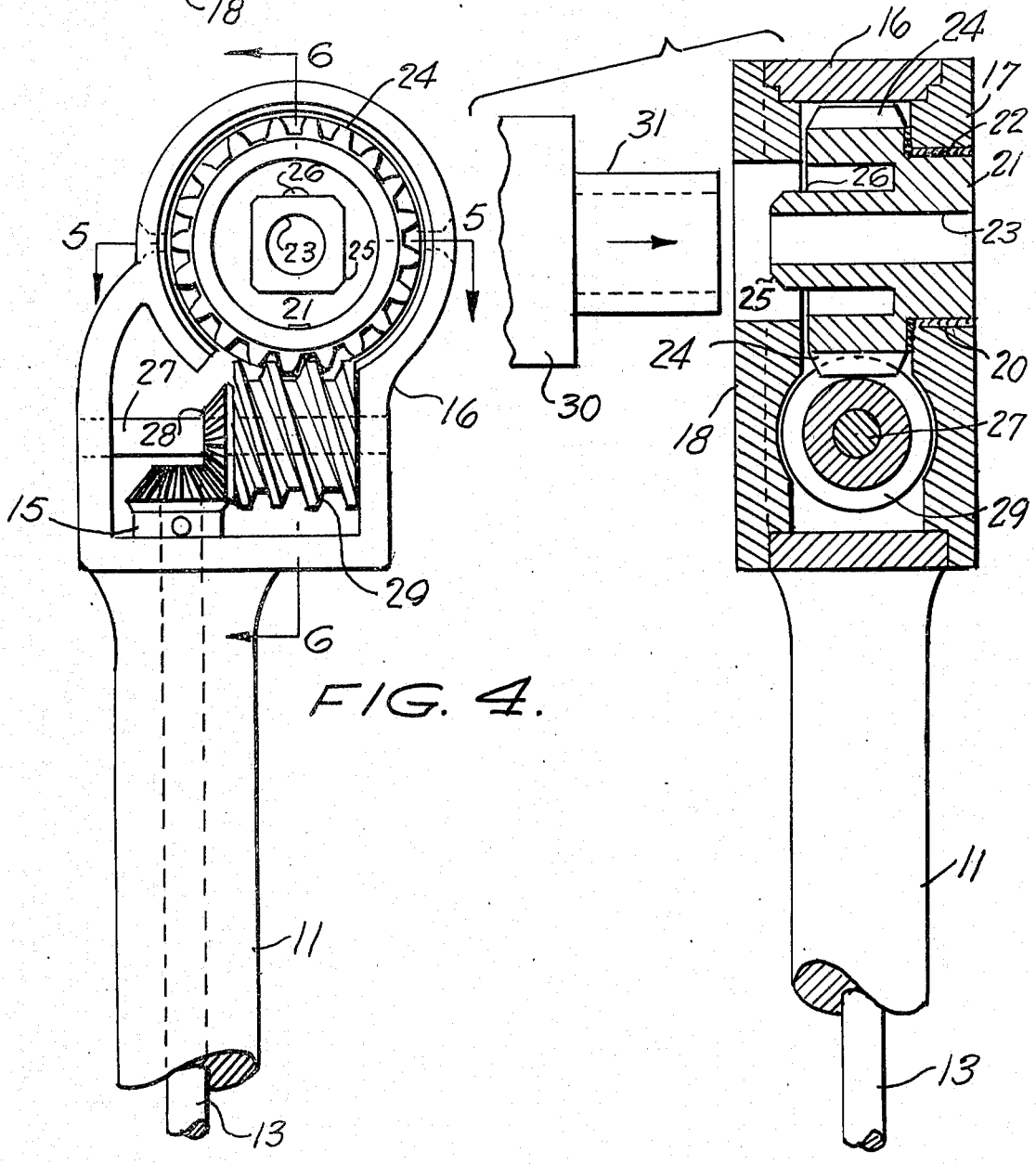
FIG. 4.

WRENCH

BACKGROUND OF THE INVENTION

1. Field of the Invention

The present invention relates to a wrench of the socket type having a hand rotatable drive member for receiving sockets of a socket wrench set.

2. Summary of the Invention

The present invention includes an elongate handle having a rotatable shaft mounted therein and provided with a knob at one end for rotating the shaft by hand. A socket drive member is rotatably mounted in the opposite end of the wrench and is connected by gears to the rotatable shaft. Socket wrenches are releasably mounted on the socket drive member for connecting the wrench to a bolt head or nut. The wrench is useful in starting nuts or bolts in positions which are impossible to reach by hand with the bolt or nut being rotated by rotating the shaft member by hand after the nut or bolt has been positioned for threading.

The primary object of the invention is to provide a wrench which can be used for starting bolts or nuts in difficult positions and which can be used to drive the bolt or nut after it has been started.

Other objects and advantages will become apparent in the following specification when considered in light of the attached drawings.

BRIEF DESCRIPTION OF THE DRAWINGS

FIG. 4 is an enlarged fragmentary elevational view similar to FIG. 3 with the socket wrench and one cover removed;

FIG. 5 is a horizontal sectional view taken on the line 5—5 of FIG. 4 looking in the direction of the arrows; and FIG. 6 is a fragmentary vertical sectional view taken along the line 6—6 of FIG. 4 looking in the direction of the arrows with parts broken away for convenience of illustration.

DESCRIPTION OF THE PREFERRED EMBODIMENT

Figure 1:
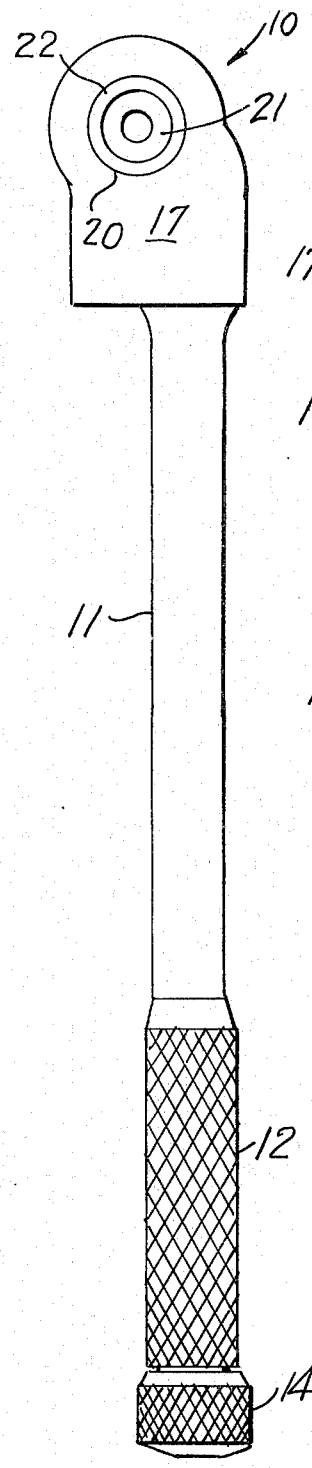
FIG. 1 is a front elevation of the invention.

Referring now to the drawings in detail wherein like reference characters indicate like parts throughout the several Figures the reference numeral 10 indicates generally a wrench constructed in accordance with the invention.

The wrench 10 has an elongate tubular handle 11 with an enlarged hand grip portion 12 adjacent one end thereof. A shaft 13 extends through the handle 11 and has a knob 14 secured to the end thereof adjacent the hand grip portion 12 of the handle 11. A bevel gear 15 is secured to the opposite end of the shaft 13.

A housing 16 is integrally secured to the upper end of the handle 11 and is provided with a pair of covers 17, 18 on opposite sides thereof. The covers 17, 18 are secured to the housing 16 by a plurality of cap screws 19 as can be seen in FIG. 5. The cover 17 has a bore 20 formed therein to journal a drive member 21 mounted therein on a bearing sleeve 22.

The drive member 21 has a central bore 23 extending therethrough to permit a bolt to extend through the drive member 21 as a nut is being placed thereon. The drive member 21 is provided with circumferential spur gear teeth 24 which are positioned centrally of the housing 16. The drive member 21 has a central square post 25 integrally formed thereon and extending within the spur gear teeth 24 and beyond. The post 25 has a resilient detent 26 for releasably securing a socket thereon.

A shaft 27 extends transversely of the housing 16 with its axis perpendicular to the axis of the shaft 13. A bevel gear 28 is journalled on the shaft 27 in mesh with the bevel gear 15. A worm gear 29 is journalled on the shaft 27 and is secured to the bevel gear 28 so as to turn when the shaft 13 is rotated. The worm gear 29 is meshed with the spur gear teeth 24 on the drive member 21 so as to rotate the drive member 21 when the knob 14 is rotated in either direction. Since the worm gear 29 has a relatively shallow pitch the drive member 21 will not rotate with respect to the housing 16 except when the knob 14 is rotated to rotate the drive member 21. Once the worm gear 29 locks the drive member 21 against rotation the wrench 10 can be used in a conventional manner to rotate a socket wrench member.

A socket member 30 has a reduced diameter tubular portion 31 which is adapted to extend into the drive member 21 and tightly engage the post 25 being releasably secured in place thereon by the detent 26.

Figure 2:
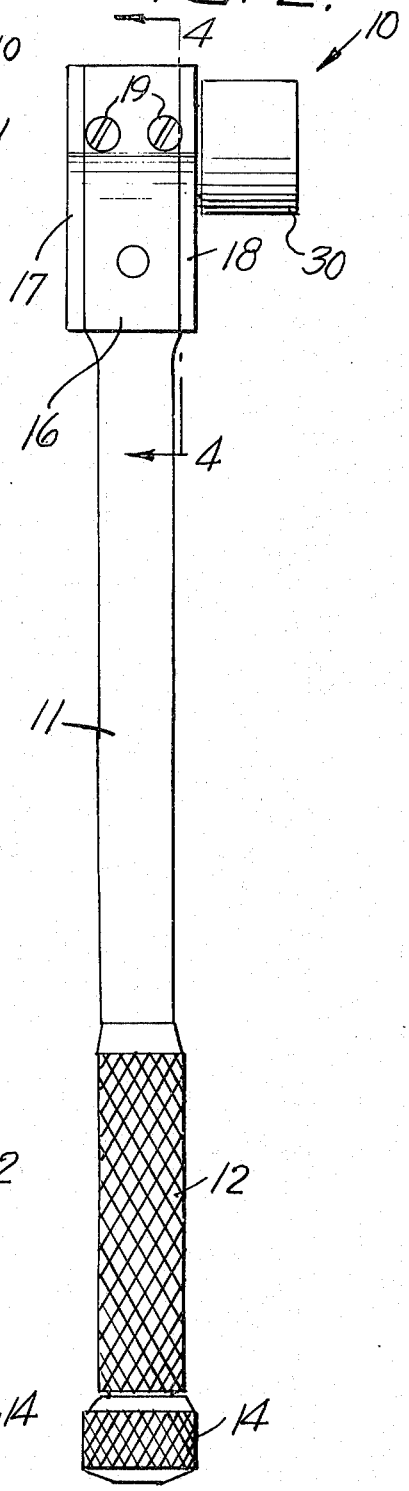
FIG. 2 is a side elevation of the invention.
Figure 3:
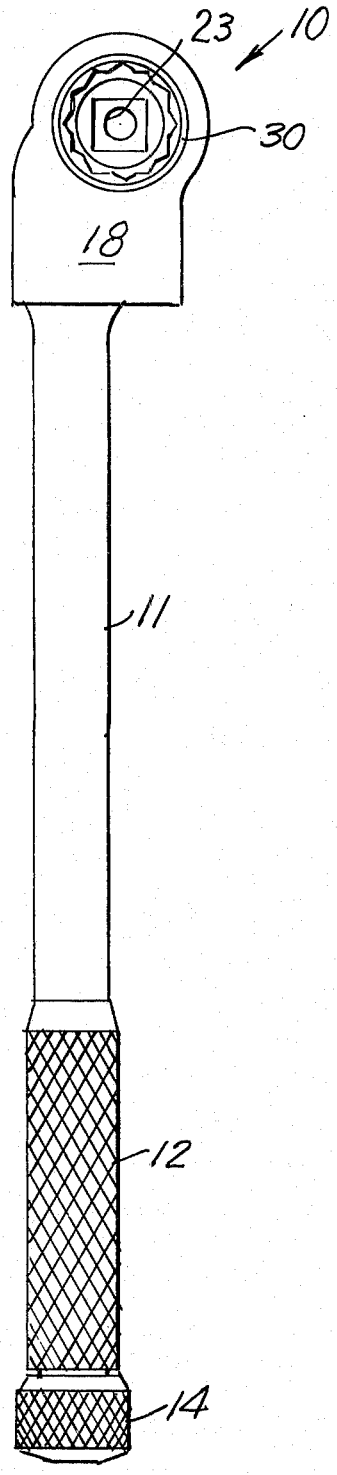
FIG. 3 is a rear elevation of the invention.

In the use and operation of the invention a socket member 30 of the desired size is fitted to the post 25 as is clearly shown in FIGS. 2 and 3. The bolt or nut to be driven is then positioned with its head in the socket member 30 and the wrench 10 is used to manipulate the threaded member onto a bolt or into the threaded opening whichever is the case. The wrench 10 is then held steady placing slight pressure inwardly so as to bring the threaded elements into engagement and then the knob 14 is turned in order to turn the socket member 30 so as to thread the threaded member onto the threads as desired. When the threaded member has been moved as far as possible with the knob 14 the wrench 10 can then be used by simply revolving it around the threaded member with the drive member 21 being locked by the worm gear 29. Once the threaded member has been started on the threads the wrench can be removed and any other type wrench substituted therefor to tighten the threaded member.

Having thus described the preferred embodiment of the invention it should be understood that numerous structural modifications and adaptations may be resorted to without departing from the spirit of the invention

What is claimed is:

1. A wrench comprising an elongate tubular handle, a housing rigidly secured to one end of said handle, a shaft extending through said handle and having a knob thereon at the end thereof opposite the housing, a bevel gear rigidly secured to the end of said shaft opposite said knob with said bevel gear lying within said housing, a shaft mounted in said housing and extending transversely thereof with its axis perpendicular to the axis of the shaft in said housing, a worm gear journalled on said last named shaft and having a bevel gear secured thereto and in mesh with the bevel gear on said first named shaft, a drive member journalled at one end in said housing on an axis generally perpendicular to said handle and slightly offset from the axis of said handle, said drive member including a spur gear meshing with said worm gear so as to rotate said drive member on rotation of said worm gear, said drive member including a post mounted centrally thereof to receive a drive socket, said spur gear spaced radially outwardly of said post and encompassing said post, and means on said post for releasably retaining said socket thereon, said drive member having a central bore extending therethrough and through said post to permit a bolt shaft to extend therethrough when of excessive length.

* * * * *